US005507631A

United States Patent [19]

Hodan

[11] Patent Number: 5,507,631

[45] Date of Patent: Apr. 16, 1996

[54] CAM PUMP FOR THE PRODUCTION OF ALTERNATING SEQUENCES OF POLYMER FLOW PULSES

[75] Inventor: John A. Hodan, Arden, N.C.

[73] Assignee: BASF Corporation, Mt. Olive, N.J.

[21] Appl. No.: 230,956

[22] Filed: Apr. 21, 1994

[51] Int. Cl.[6] ..... D01D 13/00; F04C 2/00

[52] U.S. Cl. ..... 418/205; 418/212; 425/192 S; 425/131.5; 425/463; 425/205

[58] Field of Search ..... 418/205, 212; 425/205, 131.5, 463, 192 S, DIG. 217

[56] References Cited

U.S. PATENT DOCUMENTS

| | | | |
|---|---|---|---|
| 2,822,574 | 2/1958 | Lavash . | |
| 3,180,912 | 4/1965 | Rowe, Jr. et al. . | |
| 3,453,688 | 7/1969 | Otstot et al. . | |
| 3,461,492 | 8/1969 | Emerson et al. . | |
| 3,539,282 | 11/1970 | Forschner | 418/205 |
| 3,876,114 | 4/1975 | Hicks et al. . | |
| 4,017,249 | 4/1977 | Lenk . | |
| 4,019,844 | 4/1977 | Ogasawara et al. . | |
| 4,097,546 | 6/1978 | Lofquist . | |
| 4,106,313 | 8/1978 | Boe . | |
| 4,107,418 | 8/1978 | Yatsu et al. . | |
| 4,134,882 | 1/1979 | Frankfort et al. . | |
| 4,195,051 | 3/1980 | Frankfort et al. . | |
| 4,277,230 | 7/1981 | Müller | 418/212 |
| 4,402,654 | 9/1983 | Dworak | 418/205 |
| 4,451,420 | 5/1984 | Keuchel . | |
| 4,482,347 | 11/1984 | Borsanyi . | |
| 4,806,407 | 2/1989 | Skinner et al. . | |
| 4,808,092 | 2/1989 | Funke . | |
| 5,352,106 | 10/1994 | Lenk et al. | 425/131.5 |

FOREIGN PATENT DOCUMENTS

| | | | |
|---|---|---|---|
| 6017766 | 1/1994 | Japan | 418/205 |
| 1204339 | 9/1970 | United Kingdom | 425/131.5 |

OTHER PUBLICATIONS

European Search Report, dated Oct. 8, 1995.

*Primary Examiner*—Richard A. Bertsch
*Assistant Examiner*—William Wicker
*Attorney, Agent, or Firm*—Nixon & Vanderhye

[57] ABSTRACT

Disclosed is a cam pump with two sets of driving and driven pump cams, which receive polymer melt from an extruder and exit the polymer melt through two exit channels in a sequence of ½ volume unit, followed by a 0 volume unit, followed by 1 volume unit for one exit channel and simultaneously in a sequence of ½ volume unit followed by a 1 volume unit, followed by 0 volume unit for the second exit channel. The cam pump is used in a apparatus for melt mixing and spinning synthetic polymers for the manufacture of yarns with a multiplicity of bundles of filaments, whereby the properties of all filaments in all bundles alternate along their length and the properties of the filaments of each bundle of adjacent bundles alternate between the adjacent bundles.

10 Claims, 6 Drawing Sheets

CAM PUMP FOR THE PRODUCTION OF ALTERNATING SEQUENCES OF POLYMER FLOW PULSES

The present invention relates to a cam pump for the production of alternating sequences of polymer flow pulses, which are used in an apparatus for melt mixing and spinning synthetic polymers for the manufacture of yarns with a multiplicity of bundles of filaments, whereby the properties of all filaments in all bundles alternate along their length and the properties of the filaments of each bundle of adjacent bundles alternate between the adjacent bundles.

BACKGROUND OF THE INVENTION

An apparatus for melt mixing and spinning synthetic polymers into filaments from a plurality of spinning nozzle units connected to a melt extruder through a metering pump is described in U.S. Pat. No. 4,017,249. If the characteristics of the fibers should change along their length, the synthetic polymer or additives have to be changed in the extruder. This changes the characteristics of all spun filaments along their length at once. Attempts have been made to change the properties alternately in the direction of the fiber axis. U.S. Pat. No. 4,019,844 discloses an apparatus for producing multiple layers conjugate fibers which have a housing with a rotary cylinder plug and a stationary spinning plate with a plurality of spinning orifices that are positioned and lined up with the passageways of the rotary cylinder plug. This apparatus creates a multiple layer conjugate fibers with parabolic interface. Disadvantage of this apparatus is the use of the rotary cylinder plug with is technically difficult to operate.

Object of the present invention was to provide a cam pump for the production of alternating sequences of polymer flow pulses for melt mixing and spinning synthetic polymers for the manufacture of yarns which are composed of a multiplicity of bundles of filaments, whereby the properties of all filaments in all bundles alternate along their length and the properties of the filaments of each bundle of adjacent bundles alternate between the adjacent bundles.

SUMMARY OF THE INVENTION

The objects of the present invention were achieved with a cam pump for the production of alternating sequences of polymer melt flow pulses, which comprises:

a) a housing, comprising a1) a top plate, comprising a bore and a bearing;

a2) a first cam plate, being adjacent to the top plate and comprising a first bore and a second bore, being adjacent to each other;

a3) a first divider plate, being adjacent to the first cam plate and comprising a first bore and a second bore, being adjacent to each other;

a4) a second cam plate, being adjacent to the first divider plate and comprising a first bore and a second bore, being adjacent to each other;

a5) a second divider plate, being adjacent to the second cam plate and comprising a first bore and a second bore;

a6) a gear plate, being adjacent to the second divider plate and comprising a first bore and a second bore, being adjacent to each other;

a7) a bottom plate, being adjacent to the gear plate and comprising a first bearing and a second bearing;

b) a driving arbor, being freely rotatable located within the bore of the top plate, the first bore of the first divider plate, within the first bore of the second divider plate and within the first bearing of the bottom plate;

c) a driven arbor being freely rotatable located in the bearing of the top plate, within the second bore of the first divider plate, within the second bore of the second divider plate and within the second bearing of the bottom plate;

d) a first driving pump cam, being fixedly connected to the driving arbor and being freely rotatable located within the first bore of the first cam plate;

e) a first driven pump cam, being fixedly connected to the driven arbor, being freely rotatable located within the second bore of the first cam plate, and being adjacent to the first driving pump cam;

f) a second driving pump cam, being fixedly connected to the driving arbor and being freely rotatable located with the first bore of the second cam plate;

g) a second driven pump cam, being fixedly connected to the driven arbor, being freely rotatable located within the second bore of the second cam plate, and being adjacent to the second driving pump cam;

h) means for transmitting the rotation of the driving arbor to the driven arbor, connected to the driving arbor and the driven arbor;

i) a feeding channel, being connected to the second bore of the first cam plate and the second bore of the second cam plate;

j) two exit channels, which comprise j1) a first exit channel, being connected to the second bore of the first cam plate;

j2) a second exit channel, being connected to the second bore of the second cam plate, the first driven pump cam and the second driven pump cam comprising means for receiving polymer melt from the feeding channel and exit polymer melt through the first exit channel in a sequence of a half volume unit, followed by zero volume unit, followed by one volume unit, and simultaneously through the second exit channel in a sequence of a half volume unit, followed by one volume unit followed by zero volume unit.

BRIEF DESCRIPTION OF THE DRAWINGS

Figure 1:
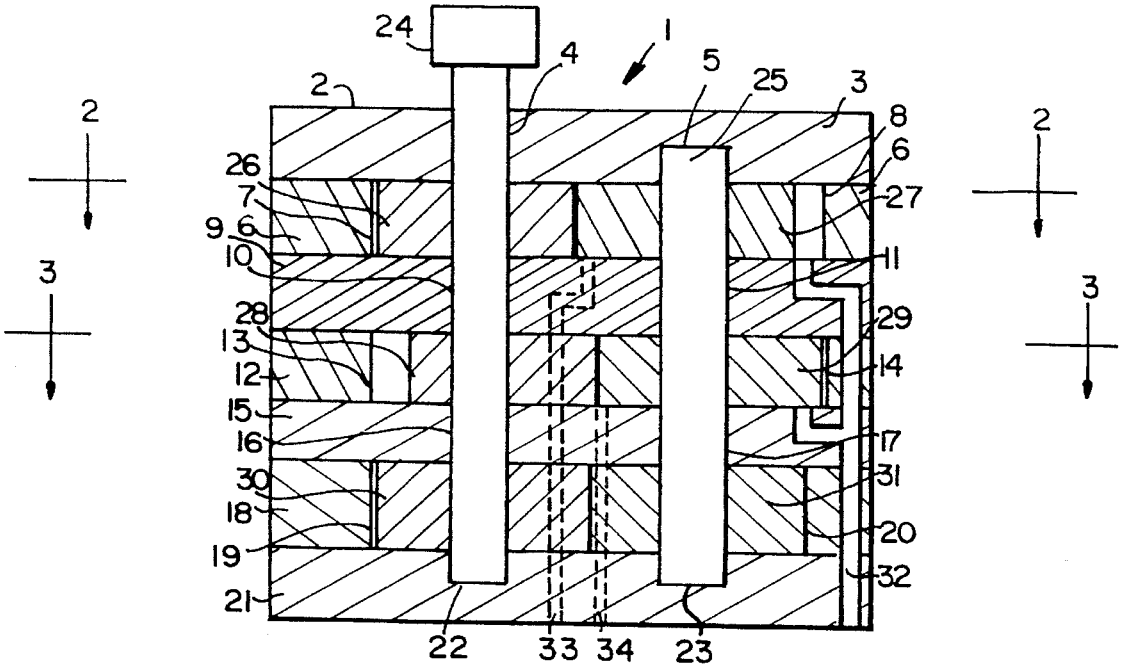
FIG. 1 is a cross-sectional view of a cam pump in accordance with the present invention.

The cam pump of the present invention is described with reference to FIG. 1 and FIG. 2. FIG. 1 shows the cross section of a cam pump (1), which has a housing (2). The housing (2) has a top plate (3) with a bore (4) and a bearing (5); a first cam plate (6) with a first bore (7) and a second bore (8), both bores (7) and (8) are adjacent to each other; a first divider plate (9) with a first bore (10) and a second bore (11); a second cam plate (12) with a first bore (13) and a second bore (14); a second divider plate (15) with a first bore (16) and a second bore (17); a gear plate (18) with a first bore (19) and a second bore (20); and a bottom plate (21) with a first bearing (22) and a second bearing (23).

The cam pump (1) further has a driving arbor (24) and a driven arbor (25). The driving arbor (24) is freely rotatable located in the bore (4) of the top plate (3), in the first bore (10) of the first divider plate (9), in the first bore (16) of the second divider plate (15) and in the first bearing (22) of the bottom plate (21).

The driven arbor (25) is freely rotatable located in the bearing (5) of the top plates (3), in the second bore (11) of the first divider plate (9), in the second bore (17) of the second divider plate (15) and in the bearing (23) of the bottom plate (21).

The cam pump (1) further has a first driving pump cam (26) and a first driven pump cam (27). The first driving pump cam (26) is fixedly connected to the driving arbor (24) and is freely rotatable located within the first bore (7) of the first cam plate (6). The first driven pump cam (27) is fixedly connected to the driven arbor (25) and is freely rotatable located within the second bore (8) of the first cam plate (6). The first driving pump cam (26) and the first driven pump cam (27) are adjacent to each other.

The cam pump (1) has a second driving pump cam (28) and a second driven pump cam (29). The second driving pump cam (28) is fixedly connected to the driving arbor (24) and is freely rotatable located within the first bore (13) of the second cam plate (12). The second driven pump cam (29) is fixedly connected to the driven arbor (25) and is freely rotatable located within the second bore (14) of the second cam plate (12). The second driving pump cam (28) and the second driven pump cam (29) are adjacent to each other.

The cam pump (1) further has a driving gear (30) and a driven gear (31) . The driving gear (30) is fixedly connected to the driving arbor (24) and is freely rotatable located within the first bore (19) of the gear plate (18). The driven gear (31) is fixedly connected to the driven arbor (25) and is freely rotatable located within the second bore (20). The driving gear (30) drives the driven gear (31).

The cam pump (1) has one feeding channel (32) and two exit channels (33) and (34). The feeding channel (32) is connected to the second bore (8) of the first cam plate (6) and the second bore of the second cam plate (12) and directs a polymer melt into the driven pump cam (27) as well as into the driven pump cam (29).

The first exit channel (33) is connected to the second bore (8) of the first cam plate (6) and directs the polymer melt from the driven pump cam (27) out of the cam pump (1).

The second exit channel (34) is connected to the second bore (14) of the second cam plate (12) and directs the polymer melt from the driven pump cam (29) out of the cam pump (1).

In an alternative, the feeding channel (32) is connected to the first bore (7) of the first cam plate (6) and the first bore (13) of the second cam plate (12) and directs a polymer melt into the driving pump cam (26) and into the driving pump cam (28).

In this alternative, the first exit channel (33) is connected to the first bore (7) of the first cam plate (6) and directs the polymer melt from the first driving pump cam (26) of the first cam plate (6) out of the cam pump (1). The second exit channel (34) is connected in this alternative to the first bore (13) of the second cam plate (12) and directs the polymer melt from the first driving pump cam (28) of the second cam plate (12) out of the pump cam (1).

Figure 2:
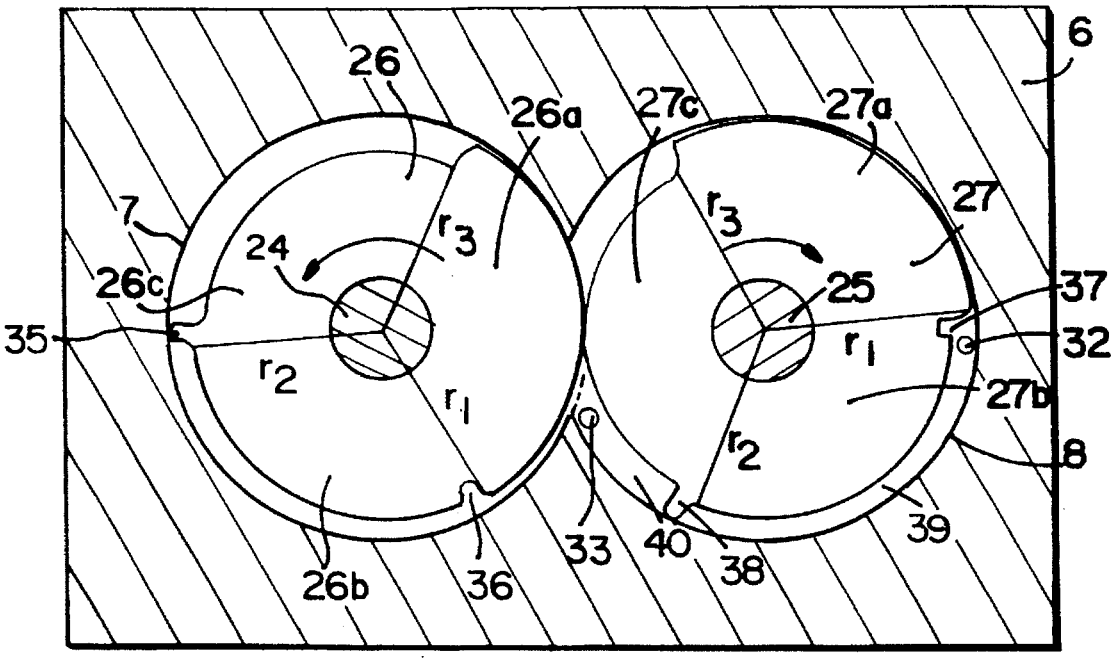
FIG. 2 is a cross-sectional view of the cam pump showing the first driving and the driven pump cam.

FIG. 2 shows a top view to a cross section of the cam pump (1) in the view direction, indicated in FIG. 1.

FIG. 2 shows the first cam plate (6) with the first bore (7) and the second bore (8), both bores being adjacent to each other. The driving arbor (24) is fixedly connected to the first driven pump cam (27), the first driving pump cam (26) and the first driven pump cam (27) are adjacent to each other. The second bore (8) has the feeding channel (32) and the first exit channel (33).

The first driving pump cam (26) is divided in three circle sections (26*a*), (26*b*) and (26*c*) with a radius $r_1$ for (26*a*), a radius $r_2$ for (26*b*) and a radius $r_3$ for (26*c*), with a radius ratio of $r_1>r_2>r_3$. Circle section (26*b*) has a slot (36) and circle section (26*c*) has a wiping lip (35).

The first driven pump cam (27) is divided in three circle sections (27*a*), (27*b*) and (27*c*) with a radius $r_1$ for (27*a*), a radius $r_2$ for (27*b*) and a radius $r_3$ for (27*c*) with a radius ratio of $r_1>r_2>r_3$. Circle section (27*b*) has a slot (37) and circle section (27*c*) has a wiping lip (38) .

The first driving pump cam (26) and the first driven pump cam (27) have the same shape and size, are counterrotatably movable in the first bore (7) and the second bore (8) of the first cam plate (6), are adjacent to each other and are shifted to each other so that the wiping lip (35) of the first driving pump cam (26) fits in the slot (37) of the first driven pump cam (27) and the wiping lip (38) of the first driven pump cam (27) fits in the slot (36) of the first driving pump cam (26) during a counterrotatory movement.

Between the second bore (8) of the first cam plate (6) and the circle section (27*b*) of the first driven pump cam (27) is a first displacement chamber (39) and between the bore (8) and the circle section (27*c*) is a second displacement chamber (40). The volume of the first displacement chamber (39) is approximate the half volume of the second displacement chamber (40). The cam pump (1) is driven by an external force like an electric motor which drives the driving arbor (24), thereby rotating the driving arbor (24), the first driving pump cam (26), the second driving pump cam (28) and the driving gear (30) directly. The driving gear (30) drives the driven gear (31) in a counterrotatory direction thereby driving the driven arbor (25) indirectly, as well as the first driven pump cam (27) and the second driven pump cam (29).

The first driven cam pump (27) is operating in three steps:

Step 1: Polymer melt from an extruder is directed through the feeding channel (32) into the bore (8) and the first displacement chamber (39) formed between the bore (8) and the first driven pump cam (27), filling the chamber during rotation of the first driven pump cam (27). When the wiping lip (38) of the first driven pump cam (27) has passed the first exit channel (33) of bore (8), polymer melt from the first displacement chamber (39) is driven out through the exit channel (33). The first displacement chamber is empty when the slot (37) of the first driven pump cam (27) has passed the first exit channel (33).

Step 2: From this moment the feeding channel (32) is closed by the first circle section 27(*a*) of the driven pump cam (27) and no polymer melt flows through exit channel (33). When the second displacement chamber (40) reaches the feeding channel (32) polymer melt flows into and fills the second displacement chamber (40) during further rotation of the driven pump cam (27).

Step 3: When the first circle section 27(*a*) has passed the exit channel (33) the polymer melt flows through the exit channel (33), until the wiping lip (38) reaches the exit channel (33). From here the whole process starts again. Because the first displacement chamber (39) has the half volume of the second displacement chamber (40), the output of the first exit channel (33) in the above described three step process is: ½ volume unit, followed by a 0 volume unit, followed by 1 volume unit of the polymer melt.

Figure 3:
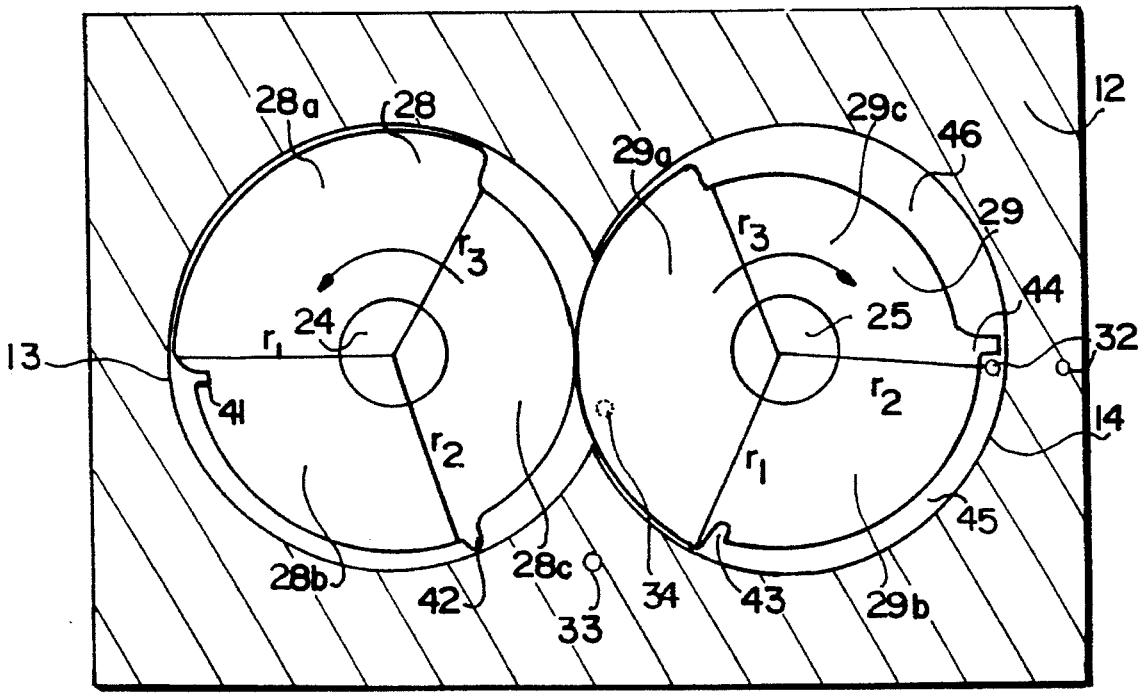
FIG. 3 is a cross-sectional view of the cam pump showing the second driving pump and the second driven pump cam.

FIG. 3 shows a top view to a cross section of the cam pump (1) in the view direction indicated in FIG. 1.

FIG. 3 shows the second cam plate (12) with the first bore (13) and the second bore (14), both bores being adjacent to each other. The driving arbor (24) is fixedly connected to the second driving pump cam (28). The driven arbor (25) is fixedly connected to the second driven pump cam (29). The second driving pump cam (28) and the second driven pump cam (29) are adjacent to each other. The second bore (14) has the feeding channel (32) and the second exit channel (34).

The second driving pump cam (28) is divided in three circle sections (28*a*), (28*b*) and (28*c*) with a radius $r_1$ for (28*a*), a radius $r_2$ for (28*b*) and a radius $r_3$ for (28*c*), with a radius ratio of $>r_1>r_2>r_3$. Circle section (28*b*) has a slot (41) and circle section (28*c*) has a wiping lip (42).

The second driven pump cam (29) is divided in three circle sections (29*a*), (29*b*) and (29*c*) with a radius $r_1$ for (29*a*), a radius $r_2$ for (29*b*) and a radius $r_3$ for (29*c*) with a radius ratio of $r_1>r_2>r_3$. Circle section (29*b*) has a slot (43) and circle section (29*c*) has a wiping lip (44) .

The second driving pump cam (28) and the second driven pump cam (29) have the same shape and size, are counterrotatably movable in the first bore (13) and the second bore (14) of the second cam plate (12), are adjacent to each other and are shifted to each other so that the wiping lip (43) of the first driving pump cam (28) fits in the slot (43) of the second driven pump cam (29) and the wiping lip (44) of the second driven pump cam (29) fits in the slot (41) of the second driving pump cam (28) during a counterrotatory movement.

Between the second bore (14) of the second cam plate (12) and the circle section (29*b*) of the second driven pump cam (29) is a third displacement chamber (45) and between the bore (14) and the circle section (29*c*) is a fourth displacement chamber (46). The volume of the third displacement chamber (45) is approximate the half volume of the fourth displacement chamber (46). The cam pump (1) is driven by an external force like an electric motor which drives the driving arbor (24), thereby rotating the driving arbor (24), the first driving pump cam (26), the second driving pump cam (28) and the driving gear (30) directly. The driving gear (30) drives the driven gear (31) in a counterrotatory direction thereby driving the driven arbor (25) indirectly, as well as the first driven pump cam (27) and the second driven pump cam (29).

The second driven pump cam (29) is operating in three steps:

Step 1: Polymer melt from an extruder is directed through the feeding channel (32) into the bore (14) and the first displacement chamber (45) formed between the bore (14) and the second driven pump cam (29), filling the chamber during rotation of the second driven pump cam (29). When the slot (48) of the second driven pump cam (29) has passed the second exit channel (34) of bore (14), polymer melt from the third displacement chamber (45) is driven out through the exit channel (34). The first displacement chamber is empty when the wiping lip (44) of the second driven pump cam (29) has passed the second exit channel (34).

Step 2: When the wiping lip (44) of the second driven pump cam (29) has passed the second exit channel (34), polymer melt flows from the fourth displacement chamber (46) into the exit channel (34) until the circle section (29*a*) closes the exit channel (34).

Step 3: When the circle section (29*a*) reaches the exit channel (34) no polymer melt flows through the exit channel (34) until slot (43) reaches the exit channel (34). From here the whole process starts again.

Because the third displacement chamber (45) has the half volume of the fourth displacement chamber (46), the output of the second exit channel (34) in the above described three step process is:

½ volume unit polymer melt, followed by 1 volume unit, followed by 0 volume unit of the polymer melt.

Table 1 shows the simultaneous polymer melt flow from exit channels 33 and 34, which result in the overall production of alternating sequences of polymer flow pulse by the cam pump (1).

TABLE I

| | Volume Unit | | |
|---|---|---|---|
| Exit Channel | 1. step | 2. step | 3. step |
| 33 | ½ | 0 | 1 |
| 34 | ½ | 1 | 0 |

Figure 4:
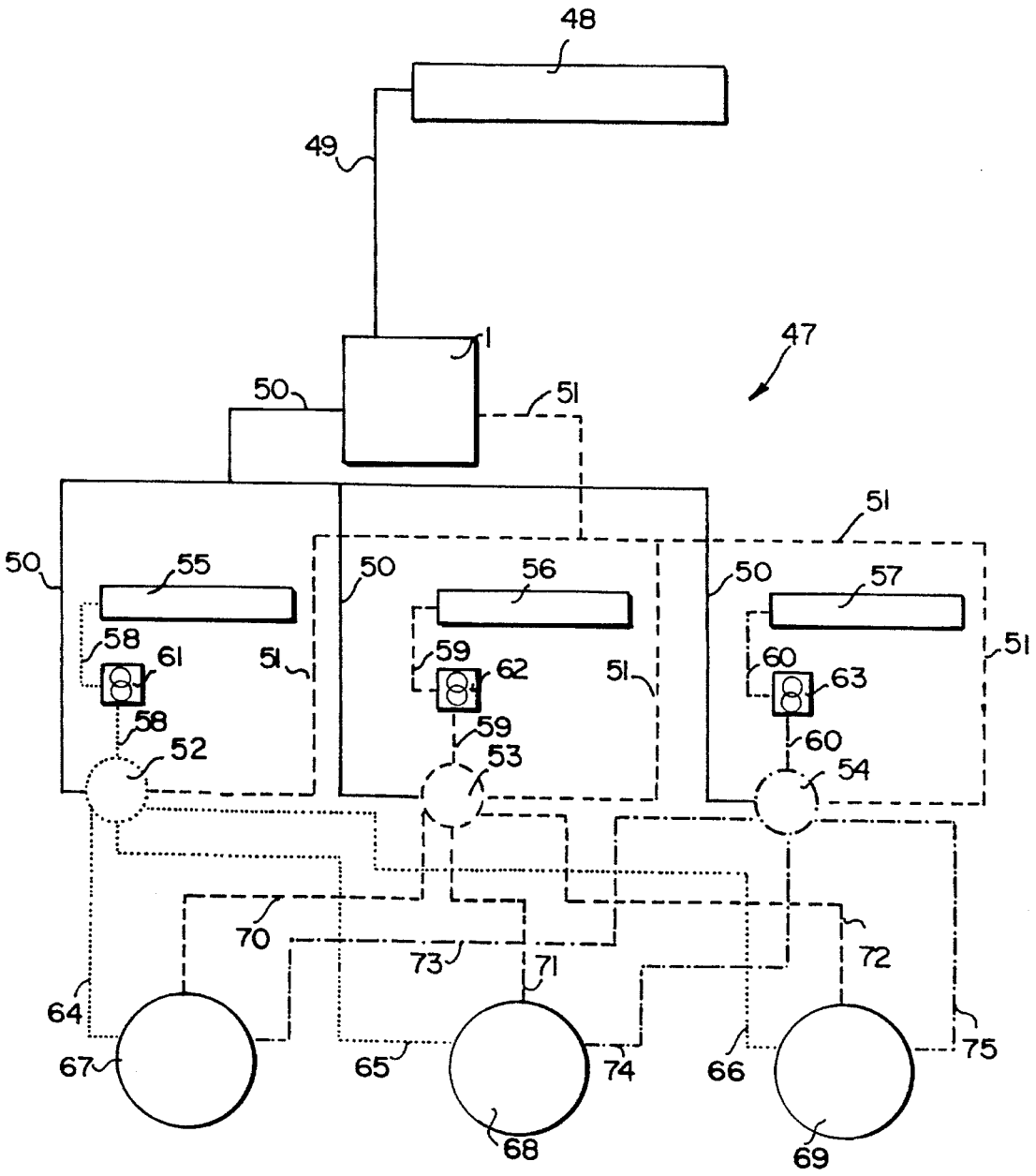
FIG. 4 is a schematic view of an apparatus for melt mixing and spinning synthetic polymers including a cam pump.

FIG. 4 shows an apparatus for melt mixing and spinning synthetic polymers (47) for the manufacture of synthetic polymer yarns whose properties change along their length and between adjacent filaments. The synthetic polymer is molten in the main extruder (48) and directed over a conduit system comprising pipe (49) to the cam pump (1), from which the polymer melt is either conducted over a first branch of a branched conduit system comprising pipes (50) or over a second branched conduit system comprising pipes (51) or over both pipes (50) and (51) to the first three way fluidic device (52), the second three way fluidic device (53) and the third three way fluidic device (54). Concentrates are formed in the first concentrate extruder (55) the second concentrate extruder (56) and the third concentrate extruder (57) and directed over pipes (58) by the first concentrate pump (61) to the first three way fluidic device (52), over pipes (59) by the second concentrate pump (62) to the second three way fluidic device (53) and over pipes (60) by the third concentrate pump (63) to the third three way fluidic device (54).

The first three way fluidic device (52) is connected over the pipe (64) with the first spinning nozzle unit (67), over the pipe (65) with the second spinning nozzle unit (68) and over the pipe (66) with the third spinning nozzle unit (69). The second three way fluidic device (53) is connected over the pipe (70) with the first spinning nozzle unit (67), over the pipe (71) with the second spinning nozzle unit (68) and over pipe (72) with the third spinning nozzle unit (69). The third three way fluidic device (54) is connected over pipe (73) with the first spinning nozzle unit (67), over the pipe (74) with the second spinning nozzle unit (68) and over the pipe (75) to the third spinning nozzle unit (69).

Figure 5:
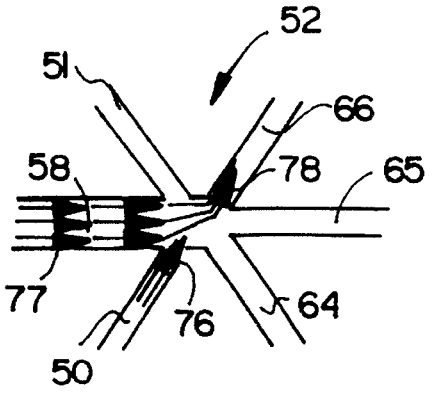
FIG. 5 is a schematic view of a three way fluidic device showing a polymer melt flow and a concentrate melt flow.

FIG. 5 shows the three way fluidic device (52) with incoming pipes (50), (58), (51), and exiting pipes (64), (65) and (66). The arrows (76) indicate the flow of the polymer, the arrows (77) indicate the flow of the concentrate and the arrows (78) indicate the flow of the polymer and concentrate mixture. In the indicated position, the polymer melt flow is directed through pipe (50), the concentrate flow is directed through pipe (58) and meets the polymer flow at the intersection of pipe (50) and pipe (58) where both flows are mixed and directed to pipe (66).

Figure 6:
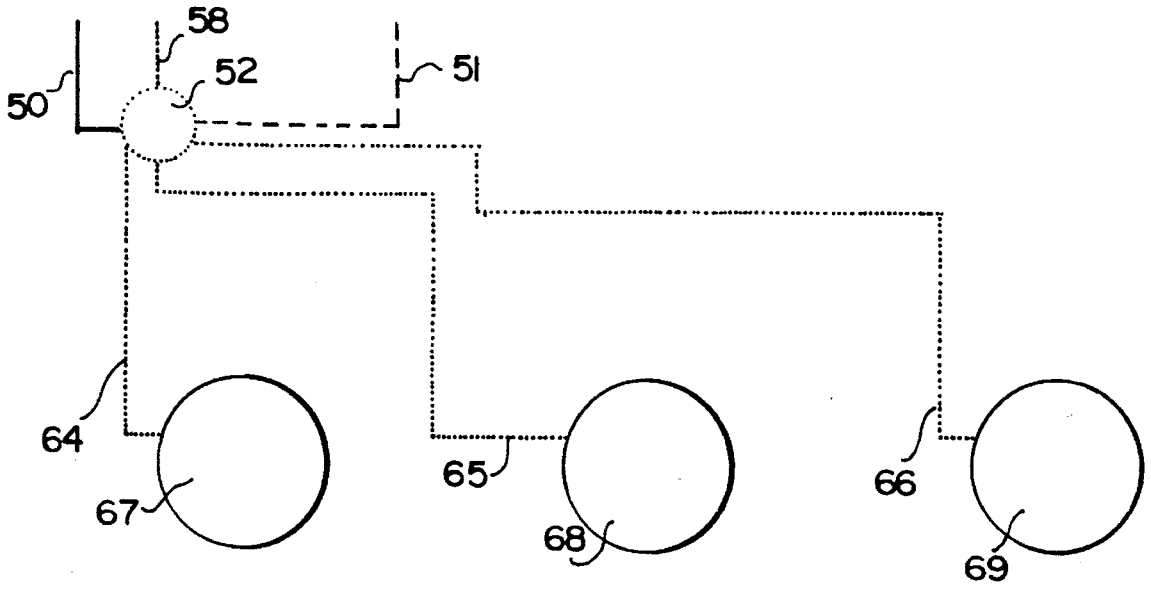
FIG. 6 is a schematic view of a detail of FIG. 4, which is a three way fluidic device with its distribution lines to three outlets.

FIG. 6 shows for the purpose of clarity a detail of FIG. 4, the first three way fluidic device (52) with the incoming pipes (50), (58) and (51) and the exiting pipes (64), (65) and (66) which are connected with the spinning nozzle units (67), (68) and (69).

Figure 7:
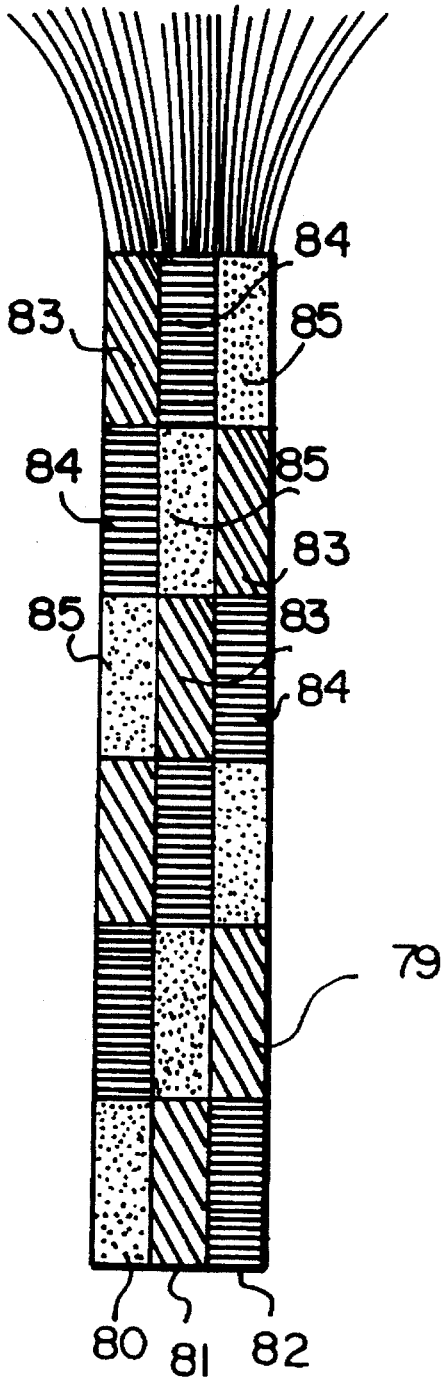
FIG. 7 is a side view of a yarn with three bundles of filaments.

FIG. 7 shows the product of the apparatus of the present invention, a yarn (79) with three bundles of filaments (80) (81) and (82), whereby the properties of all filaments in all three bundles alternate along their length (83), (84) and (85) and the properties of the filaments of each bundle of adjacent bundles (8), (8) and (8), (8) alternate between the adjacent bundles, which means that along a cross section of the yarn (79) the properties of the fibers in bundle (80), are different from the properties of the fibers in bundle (81) , which is adjacent to bundle (80) and the properties of the fibers in bundle (81) are different than the properties in bundle (82), which is adjacent to bundle (81).

According to FIG. 7 the first sequence of properties of filaments along a cross section of the yarn (79) is (83), (84) and (85), followed by the second sequence (84), (85) and (83), followed by the third sequence (85), (83) and (84).

For the manufacture of fibers all fiber forming thermoplastic materials are suitable, especially polyamides, polyesters, polyolefins, polycarbonate and polyacrylonitrile.

Suitable polyamides are nylon 6, nylon 6/6, nylon 6/9, nylon 6/10, nylon 6/12, nylon 11, nylon 12, copolymers thereof and mixtures thereof. Preferred polyamides are nylon 6 and nylon 6/6. Suitable polyesters are polyalkylene terephthalate and polyalkylene naphthalates, preferably polyethylene terephthalate. Suitable polyolefines are polymers of $C_2$- to $C_{10}$- olefins, in particular polyethylene, polypropylene and their copolymers.

For the manufacture of fibers, the polymer is fed into the main extruder (2) in form of chips or granules, or as molten resin, melted and directed through pipe (3), which is jacketed and heated by the jacketed Dowtherm® heating fluid (Dow Chemical, Midland Mich.) to the main metering pump (4).

The temperature of the melt at the exit of the extruder is from about 180° to about 350° C., according to the respective polymer.

The cam pump (1) directs the polymer melt flow through branches of a conduit system with pipes (50) and (51) to the three way fluidic devices (52) (53) and (54) according to the three steps described above:

Step 1. From pipe (49) into pipes (50) and (51), whereby the first driven pump cam exits ½ volume unit of the polymer melt into exit channel (33) and the second driven pump cam (29) exits ½ volume unit into exit channel (34).

Step 2. From pipe (49) into pipe (51), whereby the second driven pump cam (29) exits one volume unit of the polymer melt into exit channel (34).

Step 3. From pipe (49) into pipe (50), whereby the first driven pump cam (27) exits one volume unit of the polymer melt into exit channel (33).

The apparatus contains a plurality of multiple way fluidic devices, preferably from 2 to 10, most preferred from 2 to 3. Each of the multiple way fluidic devices is connected to a concentrate extruder and to a plurality of spinning nozzle units. The number of fluidic devices, concentrate extruders and spinning nozzle units is preferably the same, so that an apparatus of the present invention has two, two way fluidic devices, it also has two concentrate extruders and two spinning nozzle units. An apparatus with three, three way fluidic devices has preferably three concentrate extruders and three spinning nozzle units. As an example, the operation of the three way fluidic device is described with reference to FIGS. 4, 5 and 6.

The concentrate extruder (48) forms or melts polymer concentrates based on polymers equal to or different from the polymer used in the main extruder.

Additives like dyes, pigments, lubricants, nucleating agents, antioxidants, ultraviolet light stabilizers, antistatic agents, soil resistant, stain resistant, antimicrobial agents, flame retardants and the like are added to the polymer and melt mixed to a homogenous polymer mixture in the concentrate extruder. The additives are chosen according to the desired properties of the final filaments and yarns.

The different concentrate extruders are run with different concentrates in order to achieve the object of the apparatus of the present invention.

The concentrate melt is directed through the concentrate metering pump (61) over pipe (58) to the three way fluidic device (52).

As indicated above, the operation of the three way fluidic device (52) depends on the three steps of the cam pump (1). Three different ways are possible:

Way 1: If the polymer melt exits the cam pump (1) through exit channels (33) and (34), the polymer melt is directed through pipes (50) and (51). Both polymer melt flows direct the concentrate flow into pipe (65) and to the spinning nozzle unit (68).

Way 2: If the polymer melt exits cam pump (1) through exit channel (34), the polymer melt is directed from pipe (49) into pipe (51) and directs the concentrate flow into pipe (64) and to the spinning nozzle unit (67).

Way 3: If the polymer melt exits cam pump (1) through exit channel (33) the polymer melt is directed through pipe (50) and merges with the concentrate in the intersection of pipe (50) and (58) in the three way fluidic device (52). The polymer melt flow directs the concentrate flow into pipe (66) and to the spinning nozzle unit (69).

The three, three way fluidic devices (52), (53) and (54) are connected with the spinning nozzle units (67), (68) and (69) in such a way, that in all three steps of the cam pump (1), all spinning nozzle units are simultaneously served whereby always one spinning nozzle unit is exclusively served from one of the three way fluidic devices (52), (53) or (54) or the three different ways described above the setting of the three spinning nozzle units (67), (68) and (69) is as follows:

Way 1: Spinning nozzle unit (68) is served by fluidic device (52), spinning nozzle unit (67) is served by fluidic device (53) and spinning nozzle unit (69) is served by fluidic device (54).

Way 2: Spinning nozzle unit (67) is served by fluidic device (52), spinning nozzle unit (69) is served by fluidic device (54) and spinning nozzle unit (69) is served by fluidic device (53).

Way 3: Spinning nozzle unit (69) is served by thee way fluidic device (52), spinning nozzle unit (68) is served by fluidic device (53) and spinning nozzle unit (67) is served by fluidic device (54).

The polymer melt is spun from the spinning nozzles into a yarn.

The result is a yarn, which contains three bundles of filaments, each bundle with alternating properties along its length and with alternating properties from adjacent bundles of filaments according to FIG. 7.

The length of the filament with unchanged properties is determined by the speed of the cam pump (1) and by the spinning speed. Their length is from about 0.1 to about 2.0 m, preferably from about 0.25 to about 1.0 m and depends on the application of the yarn.

A few examples for applications are:

alternating yarn color for space dyed effect;

alternating yarn luster;

changing crimp texture capacity of yarn along its length;

yarns which have changing properties along its length;

yarns whose elongation varies along its length; and yarns whose denier varies along its length.

We claim:

1. A cam pump for the production of alternating sequences of polymer melt flow pulses, which comprises:

a) a housing, comprising a1) a top plate, comprising a bore and a bearing;

a2) a first cam plate, being adjacent to the top plate and comprising a first bore and a second bore, being adjacent to each other;

a3) a first divider plate, being adjacent to the first cam plate and comprising a first bore and a second bore;

a4) a second cam plate, being adjacent to the first divider plate and comprising a first bore and a second bore, being adjacent to each other a5) a second divider plate, being adjacent to the second cam plate and comprising a first bore and a second bore;

a6) a gear plate, being adjacent to the second divider plate and comprising a first bore and a second bore, being adjacent to each other;

a7) a bottom plate, being adjacent to the gear plate and comprising a first bearing and a second bearing;

b) a driving arbor, being freely rotatable located within the bore of the top plate, the first bore of the first divider plate, within the first bore of the second divider plate and within the first bearing of the bottom plate;

c) a driven arbor, being freely rotatable located in the bearing of the top plate, within the second bore of the first divider plate, within the second bore of the second divider plate and within the second bearing of the bottom plate;

d) a first driving pump cam, being fixedly connected to the driving arbor and being freely rotatable located within the first bore of the first cam plate;

e) a first driven pump cam, being fixedly connected to the driven arbor and being freely rotatable located within the second bore of the first cam plate, and being adjacent to the first driving pump cam;

f) a second driving pump cam, being fixedly connected to the driving arbor and being freely rotatable located within the first bore of the second cam plate;

g) a second driven pump cam, being fixedly connected to the driven arbor and being freely rotatable located within the second bore of the second cam plate and being adjacent to the second driving pump cam.

h) means for transmitting a rotation of the driving arbor to the driven arbor, connected to the driving arbor and the driven arbor;

i) a feeding channel, being connected to the second bore of the second cam plate;

j) two exit channels which comprise j1) a first exit channel, being connected to the second bore of the first cam plate;

j2) a second exit channel, being connected to the second bore of the second cam plate;

the first driven pump cam and the second driven pump cam comprising means for receiving polymer melt from the feeding channel and exit polymer melt through the first exit channel in a sequence of a half volume unit, followed by zero volume unit, followed by one volume unit, and simultaneously through the second exit channel in a sequence of a half volume unit, followed by one volume unit followed by zero volume unit.

2. The apparatus according to claim 1, wherein the means for transmitting the rotation of the driving arbor to the driven arbor comprise:

h1) a driving gear, being fixedly connected to the driving arbor and being freely rotatable located within the first bore of the gear plate;

h2) a driven gear, being fixedly connected to the driven arbor and being freely rotatable located within the second bore of the gear plate, the driven gear being driven by driving gear.

3. The apparatus according to claim 1, wherein the means for receiving polymer melt from the feeding channel and exit polymer melt through the first and second exit channel are displacement chambers.

4. The apparatus according to claim 1, wherein the fist driving pump cam and the first driven pump cam comprise a first circle section with a radius $r_1$, a second circle section with a radius $r_2$ and a third circle section with a radius $r_3$, the radius ratio being $r_1>r_2>r_3$.

5. The apparatus according to claim 4, wherein during one 360° rotation of the first driving pump cam and the first driven pump cam, the first circle section of the driving pump cam is in contact with the third circle section of the first driven pump cam, the second circle section of the driving pump cam is in contact with the second circle section of the first driven pump cam and the third circle section of the driving pump cam is in contact with the first circle section of the driven pump cam.

6. The apparatus according to claim 4, wherein the second circle section of the first driving pump cam and the first driven pump cam comprises a slot and the third circle section of the first driving pump cam and the first driven pump cam comprises a wiping lip, so that during one 360° rotation of the first driving pump cam and the first driven pump cam, the wiping lip of the first driving pump cam is fitting in the slot of the first driven pump cam and the wiping lip of the first driven pump cam is fitting in the slot of the first driving pump cam.

7. An apparatus for melt mixing and spinning synthetic polymers, which comprise:

a) a plurality of spinning nozzle units;

b) a main extruder with a capacity sufficient to feed a polymer melt to said plurality of spinning nozzle units;

c) a branched conduit system comprising a first branch and a second branch being connected to the main extruder and to said spinning nozzle unit;

d) a plurality of multiple way fluidic devices;

e) a cam pump according to claim 1 for receiving said polymer melt from said main extruder and for directing said polymer melt through said first branch or through said second branch and through said multiple way fluidic devices to said plurality of spinning nozzle units, thereby directing the way within said multiple way fluidic devices;

f) means for directing a plurality of concentrates through said multiple way fluidic devices to said spinning nozzle units;

each of said multiple way fluidic devices thereby being able to combine said polymer melt received from said first branch with one of said concentrates to a polymer melt mixture and directing said polymer melt mixture to one of said plurality of spinning nozzle units or combining said polymer melt received from said second branch with one of said concentrates to a polymer melt mixture and directing said polymer mixture to another one of said plurality of spinning nozzle units.

8. The apparatus according to claim 7, wherein the means for directing a plurality of concentrates comprise a plurality of concentrate extruders and a plurality of concentrate metering pumps, the concentrate metering pumps receiving the concentrates from the concentrate extruders through a concentrate conduit system and directing the concentrate to said multiple way fluidic devices.

9. The apparatus according to claim 7, wherein the number of said plurality of spinning nozzle units; said multiple way fluidic devices and means for directing a plurality of concentrates is the same.

10. The apparatus according to claim 9, wherein said number is 2 or 3.

* * * * *